US009470481B2

(12) United States Patent
Livesey et al.

(10) Patent No.: US 9,470,481 B2
(45) Date of Patent: Oct. 18, 2016

(54) ARMOR ASSEMBLY

(75) Inventors: Christopher James Livesey, Wellington (GB); Kamaljeet Singh Sagoo, West Midlands (GB); Simon James Hurst, Rotherham (GB)

(73) Assignee: BAE SYSTEMS plc, London (GB)

( * ) Notice: Subject to any disclaimer, the term of this patent is extended or adjusted under 35 U.S.C. 154(b) by 113 days.

(21) Appl. No.: 13/820,281

(22) PCT Filed: Sep. 2, 2011

(86) PCT No.: PCT/GB2011/051650

§ 371 (c)(1),
(2), (4) Date: Mar. 1, 2013

(87) PCT Pub. No.: WO2012/028888

PCT Pub. Date: Mar. 8, 2012

(65) Prior Publication Data

US 2013/0160640 A1 Jun. 27, 2013

(30) Foreign Application Priority Data

Sep. 2, 2010 (GB) ..... 1014569.6

(51) Int. Cl.
*F41H 5/02* (2006.01)
*F41H 5/013* (2006.01)

(52) U.S. Cl.
CPC ..... *F41H 5/023* (2013.01); *F41H 5/013* (2013.01)

(58) Field of Classification Search
CPC ..... F41H 5/013; F41H 5/023; F41H 5/026
USPC ..... 89/36.02
See application file for complete search history.

(56) References Cited

U.S. PATENT DOCUMENTS 1,438,109 A * 12/1922 Hale ..... F41H 1/02 109/11
2,372,636 A * 3/1945 Mindt ..... F41H 5/26 109/58.5
2,392,215 A * 1/1946 Abrams ..... F41H 5/026 109/21.5
3,736,838 A * 6/1973 Butterweck et al. ..... 89/36.02
3,765,299 A * 10/1973 Pagano ..... F41H 5/0442 89/36.08
4,005,662 A * 2/1977 Kohn et al. ..... 109/16
4,325,309 A 4/1982 King et al.
4,716,810 A * 1/1988 DeGuvera ..... 89/36.02
4,727,789 A * 3/1988 Katsanis et al. ..... 86/50
5,007,326 A * 4/1991 Gooch et al. ..... 89/36.02

(Continued)

FOREIGN PATENT DOCUMENTS

DE 4035890 A1 * 5/1992 ..... F41H 1/02
DE 196 34 227 C1 1/1998

(Continued)

OTHER PUBLICATIONS

International Search Report (PCT/ISA/210) issued on Nov. 25, 2011, by the Great Britain Patent Office as the International Searching Authority for International Application No. PCT/GB2011/051650.

(Continued)

*Primary Examiner* — Gabriel Klein
(74) *Attorney, Agent, or Firm* — Finch & Maloney PLLC

(57) ABSTRACT

An armor system, comprising at least two elements, wherein the elements are arranged at an angle, characterized wherein the at least two elements include a plurality of perforations.

20 Claims, 7 Drawing Sheets

(56) References Cited

U.S. PATENT DOCUMENTS

| | | | | |
|---|---|---|---|---|
| 5,014,593 | A * | 5/1991 | Auyer et al. | 89/36.02 |
| 5,122,336 | A * | 6/1992 | Roux | C22C 38/44 148/335 |
| 5,149,910 | A | 9/1992 | McKee | |
| 5,187,316 | A * | 2/1993 | Hasler | A62B 13/00 109/1 S |
| 5,370,034 | A | 12/1994 | Turner et al. | |
| 6,086,122 | A | 7/2000 | Dieterich et al. | |
| 6,405,630 | B1 * | 6/2002 | Gonzalez | 89/36.02 |
| 6,605,340 | B1 * | 8/2003 | Heiniger | 428/209 |
| 7,191,694 | B1 * | 3/2007 | Gonzalez | 89/36.02 |
| 7,473,167 | B2 * | 1/2009 | Marmosh | 454/270 |
| 2004/0255768 | A1 * | 12/2004 | Rettenbacher et al. | 89/36.02 |
| 2005/0257677 | A1 | 11/2005 | Ravid et al. | |
| 2010/0251883 | A1 * | 10/2010 | Naroditsky | 89/36.02 |
| 2011/0168000 | A1 * | 7/2011 | Langner | F41H 5/24 89/36.02 |
| 2011/0226122 | A1 | 9/2011 | Ciriscioli et al. | |
| 2013/0152774 | A1 * | 6/2013 | Gonzalez | 89/36.02 |
| 2013/0180393 | A1 * | 7/2013 | Kienzle et al. | 89/36.02 |
| 2014/0013934 | A1 * | 1/2014 | Inglefield et al. | 89/36.02 |

FOREIGN PATENT DOCUMENTS

| | | | | |
|---|---|---|---|---|
| EP | 0 209 221 | A1 | 1/1987 | |
| EP | 0 213 268 | A1 | 3/1987 | |
| EP | 1 574 810 | A1 | 9/2005 | |
| GB | 126671 | A * | 5/1919 | F41H 5/02 |
| GB | 1 500 899 | A | 2/1978 | |
| WO | WO 2009/004596 | A2 | 1/2009 | |
| WO | WO 2009/048942 | A2 | 4/2009 | |

OTHER PUBLICATIONS

Great Britain Search Report issued on Dec. 10, 2010.

"MTL to unveil new armour on exhibition tour," Insider Media Limited, URL: www.insidermedia.com > Yorkshire, Sep. 3, 2010, 1 page.

"MTL Group Unveils Latest Armour Protection," Army Guide, URL: www.army-guide.com/eng/article/article.php?forumID=1914, Sep. 4, 2010, 2 pages.

"MTL Group unveils latest armour protection," Metal Supply, URL: http://www.metal-supply.com/article/view/52965/mtl_group_unveils_latest_armour_protection#.U_9_GGBOwqQ, Sep. 6, 2010, 1 page.

"IMPAS Armour Protection," mtl group, URL: www.mtlgrp.com/Data/Sites/1/userfiles/pdf/impas.pdf, actual publication date unknown (2010 or 2011?), downloaded Aug. 5, 2014, 4 pages.

"IMPAS Armour Protection," mtl group, URL: http://www.mtlgrp.com/impas-armour-protection.aspx, Oct. 10, 2011, 2 pages.

"MTL Group introduces IMPAS armour protection," Metal Supply, URL:http://www.metal-supply.com/article/view/69859/mtl_group_introduces_impas_armour_protection#.VDgQTv10ytU, Oct. 7, 2011, 1 page.

Australian Examination Report for application No. 2011298116 issued on Oct. 9, 2015, 6 pages.

* cited by examiner

ARMOR ASSEMBLY

This invention relates to an armor assembly and, more particularly, to an additional armor or applique style armor to provide additional protection to the primary armor system and to an armor assembly that is attachable to a vehicle.

BACKGROUND

Vehicles, such as military vehicles, sometimes require armor to protect the vehicle and its occupants from harm when the vehicle is in a hostile environment, for example. The type of armor used on a vehicle will primarily depend on the type of anticipated threat, but consideration will also need to be given to the effect of the armor on the vehicle's performance (e.g. the effect on speed and/or maneuverability due to the weight of the armor).

Applique armor is routinely used to provide a sacrificial or readily replaceable piece of armor, which defeats certain threats very effectively, but may not provide high levels of general protection from all forms of hazard threats likely to be encountered.

It is known to use perforated armor plates to protect against kinetic energy projectiles such as ballistic firearm ammunition. Perforated armor comprises a sheet of armor, such as hardened steel, with a plurality of holes therethrough. In addition to being less heavy than solid armor (due to the presence of the holes), perforated armor can provide improved protection against ballistic projectiles. This improved protection at least partly arises from the increase in edged surfaces (i.e. around each hole) that are presented to an incoming ballistic projectile. With an increase in edged surfaces, an Incoming ballistic projectile is statistically more likely to impact (or, at least, partially impact) on one of the edged surfaces and thereby experience a higher pressure than it would if it was to impact on a flat surface (such as unperforated armor). The increase of pressure increases the likelihood of the ballistic projectile disintegrating on impact or being deflected and thereby reducing its energy, and thus its ability to penetrate the armor.

An example of an armor assembly comprising perforated armor is described in EP-A-0209221 (The State of Israel Ministry of Defence Rafael—Armament Development Authority). The armor assembly of EP-A-0209221 is specifically designed for armored vehicles and comprises a perforated armor plate mounted to a conventional armor plate and spaced therefrom.

As mentioned above, whilst the addition of armor increases a vehicle's defenses against ballistic projectiles, the added weight can impair the vehicle's ability to maneuver and travel at its optimal or preferred speed or acceleration rate, even when lighter perforated armor is used. This is a particular problem when considering vehicles that may be travelling in and out of known safe areas where no or less protection is required, or when travelling in areas where it is undesirable to compromise the vehicle's speed, acceleration or maneuverability. In these cases, the armor must be removed from the vehicle which is an onerous task that requires the personnel to be in possession of the appropriate tools.

It is an object of the present invention to provide an armor assembly that overcomes the problems associated with the prior art.

BRIEF SUMMARY OF THE DISCLOSURE

According to a first aspect of the invention there is provided an armor system, comprising at least two elements, wherein said elements are arranged at an angle ($\alpha$)° characterized wherein said at least two elements comprise a plurality of perforations.

Preferably, there are a plurality of said at least two elements arranged to provide a body or panel of armor. More preferably there is a plurality of at least two elements abutted along their longest dimension, so as to provide a repeating arrangement, in the form of a chevron arrangement. The at least two elements are preferably elongated at least two elements.

The perforations when provided on an angled surface give rise to an effective perforation dimension which is approximately 30% less than if the perforation were presented on a substantially flat armor plate, i.e. when said plate is viewed normal to the plane, (or normal to an incoming munition fired directly at a target). This allows the use of larger dimensioned perforations, to achieve the required effect, with a concomitant reduction in mass of said armor. Alternatively, the same sized perforations as used on conventional flat armor may be used but with up to a 30% reduction in the effective dimension of said perforation.

It is possible to have only one element provided at an angle in a louvre arrangement, which will provide protection from a projectile that is fired at an angle normal to the armor.

However, a single louvre will provide only limited protection from any projectiles that are fired upwardly from ground level. An array of single louvres would require large numbers of elements, and each element would require a greater depth, to significantly reduce or eliminate any risk of upwardly fired projectiles. This would result in a system that is very bulky, i.e. very thick panel, and also possess a very high mass.

The at least two elements when combined typically form a chevron shaped surface. There may be more than two elements, such as, for example 3 or 4 elements, which when arranged may provide a triangular or square pyramidal shaped arrangement. It will be clear that any three dimensional geometric arrangement can be made from two, three, four or indeed a plurality of elements, however, the more complex the geometric shape, the more costly it will be to produce.

The at least two elements may be independently selected from any material, such as a metal, metal alloy, metalloid, ceramic, polymer or composite. Preferably the material is a known armor material, such as a high hardness steel or titanium. The at least two elements, may have a surface which is substantially flat, curved or undulating, preferably the surface of the at least two elements is substantially flat, such as, for example, to provide a chevron or V shaped cross section.

The at least two elements may be joined at their apex, and/or their troughs, by a reversible mechanical fixing, or they may be permanently fixed together by means of a weld or adhesive. The at least two elements may be prepared from one piece of material. Furthermore a plurality of at least two elements may be prepared from one piece of shaped material, to provide repeating units.

The angle between the at least two elements is preferably in the range of from 40° to 130°, more preferably In the range of from 60° to 120°, yet more preferably of from 80° to 110°. The preferred angle for two elements is substantially 90° to provide a chevron. If the angle is too acute, i.e. less than 40° the aspect of the chevron is very steep and there are too few perforations that are being presented to cause disruption of incoming projectiles. Further if the angle is too obtuse, i.e. greater than 130°, then the chevron is fairly flat such that the effective diameter of the perforation tends towards that of a flat perforation armor panel.

The at least two elements are preferably arranged such that the surface face of the at least two elements are repeatedly angled upwards and downwards, and their longest axis is substantially parallel with the ground plane that the wheel base of the vehicle is located upon, as this provides a consistent level of protection In azimuth. The performance of the armor system may be reduced if the at least two elements longest axis was mounted substantially perpendicular to said ground plane. It is more likely that the vehicle will attacked by a projectile incoming from a range of azimuth angles, but will predominantly be shot from within a few degrees off horizontal for elevation.

The perforation may have a shortest dimension which is less than the diameter of the primary threat projectile. Where the perforation is circular the diameter of the perforation is less than the diameter of the primary threat projectile. The perforation may be provided as a partial perforation, such as, for example a blind hole that does not extend all the way through the at least two elements, or more preferably the perforation is a full perforation, such that the hole/perforation extends all the way through the at least two elements.

The perforation may have any shape, preferably a polygon, more preferably the shape is selected from circular, square, elliptical, and slots; other configurations to provide identification or insignia may be selected. Preferably the perforation is circular. In a further arrangement the perforation may have a bevelled edge, so as to provide different cross section size of perforation on a front face and rear face of each said at least two elements.

The distance between perforations is selected to provide strength in the armor system, but also to maximize the number of perforations per unit area. Preferably the perforations have a longest dimension, and the distance between each perforation may be at least one half of the length of said longest dimension. Therefore in an armor system with circular perforations, the distance between each perforation is substantially half of the diameter of the circular perforation.

Where the armor is fitted to a vehicle, and said vehicle passes through terrain comprising mud, stones, etc, the perforations may become partially or completely blocked with unwanted debris. This adds extra mass, and may cause accelerated corrosion, and further may reduce the effectiveness of the perforations. In a preferred arrangement the perforations may be filled with a potting compound, such as, for example a resin, polymer, or rubber. The potting compound is designed to keep the perforation free from debris, and potentially mask the presence of perforations.

An alternative means of masking the presence of the perforations is to provide a sheet of substantially flat armor material which may be located on the outer facing surface, which optionally contains perforations.

Louvre arrangements are often used on vehicles in theatre to provide thermal ID panels, by reflecting IR radiation from space, so as to provide cold patches on a thermally hot vehicle. In a preferred arrangement at least one of the at least two elements may be provided with an IR reflective coating. The elements which face skywards, namely at 45° away from the normal towards the sky require IR coating, both of the at least two elements may be coated if the device can be fixed in any orientation.

In a further embodiment of the invention there is provided a first set of at least two elements, and second set of at least two elements such that said second set is mounted behind the first, to provide a tandem arrangement. Alternatively, the rear set of at least two elements may be orientated at an angle, such as, for example, 90° to the first set of at least two elements.

The armor system may sustain damage during use, preferably one or more elements are independently removable and replaceable with new at least two elements.

In a further aspect of the invention there is provided an armor applique system, comprising a housing which is mountable onto a vehicle, vessel or craft, said housing comprising a plurality of at least two elements, wherein said elements are arranged at an angle ($\alpha$)° in the range of from 40° to 130° characterized wherein said at least two elements comprise a plurality of perforations.

The applique system is designed as a modular arrangement such that it may be readily retrofitted to an existing armor arrangement, without an extensive refitting program. In a further arrangement the applique system may be readily removable such that a damaged applique system can be replaced without removing the vehicle from active service. The replacement of an element or the at least two elements may then be undertaken at a separate location to the vehicle.

The at least two elements are arranged, such that the axis of their longest dimension is substantially parallel with respect to the ground plane, upon which the vehicle wheel base is located thereon.

The armor applique may be entirely potted in with a potting compound, as hereinbefore defined, to provide the appearance of a non perforated structure.

In an alternative arrangement the at least two elements may be prepared from a single piece of armor material which is formed to provide at least two surfaces, which provide the same effect as the at least two elements as hereinbefore defined. In a further aspect of the invention there is provided an armor system, comprising at least one element, wherein each element comprises at least two surfaces arranged at an angle ($\alpha$)° characterized wherein said element comprises a plurality of perforations. Furthermore, the repeating units of elements may be prepared from one piece of material.

In accordance with another aspect of the present invention there is provided an armor assembly comprising:

- a rigid frame arranged to be attached to a vehicle; and
- a plurality of armor plates releasably mountable to the frame and removable therefrom;
- wherein each of the plurality of armor plates comprises a plurality of apertures therethrough.

The armor assembly of the present Invention provides protection against ballistic projectiles such as bullets and other firearm ammunition, but allows the armor plates to be easily removed when not required so that the vehicle's performance is not unduly compromised. Preferably, the frame is attached to the vehicle and remains attached, whereas the armor plates may be mounted and unmounted from the frame when desired. The frame of the armor assembly is rigid so that the whole assembly is strong and is effective at protecting against incoming ballistic projectiles.

An additional advantage of the armor assembly of the present invention is that if one or more of the armor plates gets damaged, only the damaged armor plates need to be replaced, thereby reducing costs and the burden of replacing damaged armor. This is in contrast to prior art arrangements where the entire plate (which is often large and may cover an entire side of a vehicle) needs to be replaced if a portion of it gets damaged. This is a significant feature as individual damaged armor plates may be replaced quickly without the requirement of specialist tools (in preferable embodiments) in a potentially hostile environment where it would be highly undesirable to be travelling in a vehicle with damaged and compromised armor.

In a preferable embodiment, the frame defines a frame plane, where each of the plurality of armor plates has a longitudinal axis and is releasably mountable to the frame so that each longitudinal axis may be orientated substantially parallel to the frame plane. This preferable embodiment allows a regular array of armor plates to be arranged in the frame which offers a particularly effective armor arrangement against ballistic projectiles, but also allows for simple, quick and easy mounting and unmounting of the armor plates in the frame. In a particularly preferable embodiment, the plurality of armor plates may be orientated so that each armor plate is adjacent to at least one other armor plate. In this embodiment, protection provided by the armor assembly is maximized.

In one preferable embodiment, each of the plurality of armor plates has a face, and the plurality of armor plates may be orientated so that the face of each armor plate is perpendicular to the face of the at least one other armor plate. In this embodiment the armor plates are orientated in a preferential arrangement that is particularly effective at providing protection from ballistic projectiles, due to the orientation of the edges of the holes in the armor plates.

The frame preferably has four walls including a top wall, a bottom wall and two side walls extending between the top and bottom walls; and wherein the top wall comprises top guides and the bottom wall comprises bottom guides, and the top and bottom guides are arranged so that each of the plurality of armor plates is releasably mountable in both a top guide and a bottom guide. In this preferable embodiment, the frame has a particularly strong structure whereby the plurality of armor plates are mounted thereon and the risk of disruption of the arrangement of armor plates due to compromise of the frame structure is minimized. In a further preferable embodiment, the top guides are top slots in the top wall and the bottom guides are bottom slots in the bottom wall, wherein each of the slots is arranged to receive one of the plurality of armor plates. In this preferable embodiment, the slots provide a means of guiding the armor plates into and out of frame when mounting and unmounting and provide a secure means of preventing unwanted movement of the armor plates relative to the frame when in position in the frame.

Further preferably, each of the plurality of armor plates comprises a body portion and a bottom tab extending from the body portion in a direction parallel to the longitudinal axis, where the bottom tab is smaller than the body portion in at least one direction perpendicular to the longitudinal axis; and wherein the bottom tab is receivable in one of the bottom slots of the bottom wall, and where the bottom slot is sized so as to prevent passage of the body portion therethrough. This preferable embodiment provides an improved means of securely retaining the armor plates in the frame and limits further movement along a direction parallel to the longitudinal axes of the plates once a suitable position has been reached.

Alternatively or additionally, each of the plurality of armor plates comprises a removal tab that facilitates the removal of the armor plate from the frame. In one preferable embodiment the removal tab is configured to be gripped by a hand thereby facilitating manual removal. In an alternative preferable embodiment, the removal tab is configured to be engaged by a removal tool thereby providing a means for removing the armor plates from the frame using a tool which may be automatic and non-manual. In one preferable embodiment, the removal tab extends from the body portion of each armor plate in a direction parallel to its longitudinal axis from an opposite end of the body portion to the bottom tab.

In preferable embodiments, the armor assembly further comprises a locking mechanism that releasably locks the plurality of armor plates in a configuration when mounted to the frame. In this embodiment, the locking mechanism ensures that the armor plates are securely mounted to the frame and are unable to be unmounted therefrom until the locking mechanism is unlocked.

Each of the plurality of armor plates preferably comprises an armor steel plate.

In accordance with a further aspect of the present invention there is provided a vehicle comprising the armor assembly of the present invention. The vehicle will benefit from having the ability to have the armor plates quickly and easily removed when they are not needed or replaced with lighter or heavier armor plates as desired, and the ability to have individual armor plates replaced if they become damaged, for example. Therefore the vehicle is afforded a flexibility with regards to its armor protection which can allow the vehicle to easily switch between different levels of protection as it travels through environments of varying hostility.

BRIEF DESCRIPTION OF THE DRAWINGS

Embodiments of the invention are further described hereinafter with reference to the accompanying drawings, in which.

DETAILED DESCRIPTION

Figure 1:
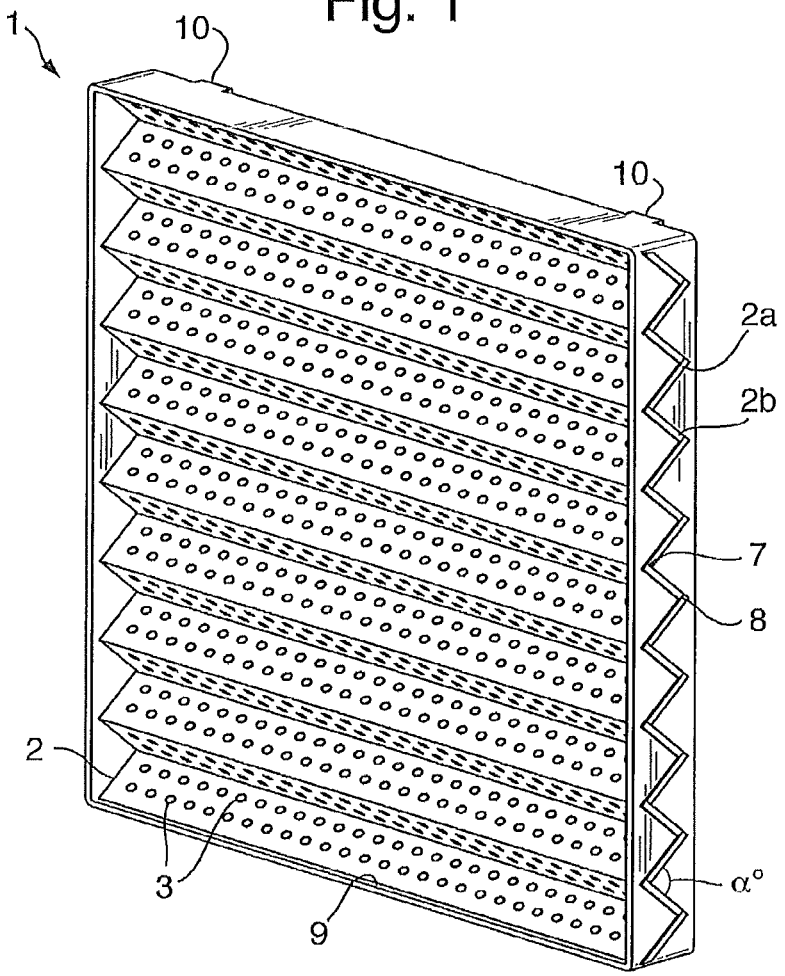
FIG. 1 shows an armor system within a housing.

Turning to FIG. 1, there is provided an armor system 1, which is optionally contained in a housing 9 (or frame) to form an applique armor system, or the armor 1 may be directly applied to an existing armor structure. The housing 9 contains a plurality of at least two elements 2, wherein elements 2*a*,2*b* are joined at their apex 7 and troughs 8, to form a continuous armor system. The elements 2, comprise a plurality of perforations 3. The housing may be fixed by lugs 10 to a vehicle. The elements 2*a* and 2*b*, are set an angle (α)° so as to provide a chevron arrangement. The elements 2*a*, 2*b* in this arrangement are provided as elongate elements. The device is mounted on the vehicle such that the elements 2, their longest dimension axis is substantially parallel with the ground plane on which the vehicles wheel base is located (see FIG. 4).

Figure 2:
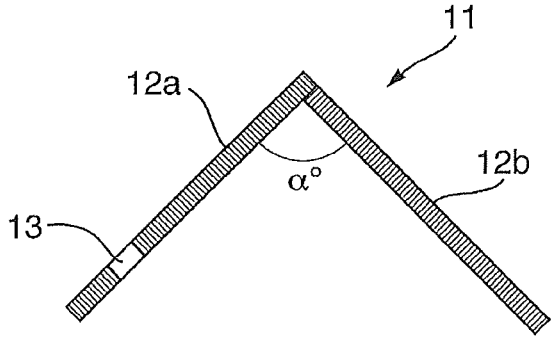
FIG. 2 shows a cross section of the at least two elements and the separation angle (α)°.

FIG. 2 shows a cross section of elements 12*a* and 12*b* angled apart from each other an angle (α), with a perforation 13 located in the elements.

Figure 3:
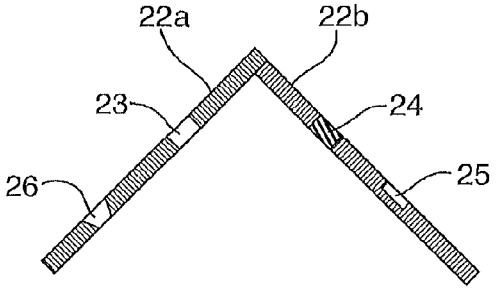
FIG. 3 shows a cross section of the at least two elements with different perforation arrangements.

FIG. 3 shows a cross section as in FIG. 2, wherein perforation 23 is a substantially circular cross sectioned perforation which extends all the way through the element 22*a*. A further example of a perforation is a bevelled edge perforation 26, wherein the diameter of the perforation on the outer surface of element 22*a* is larger than the diameter of the perforation on the inner surface of element 22*a*. As described above, the vehicles may during manoeuvres pick up debris, which may block the perforations 23, therefore it may be advantageous to provide a plug 24, provided by a potting compound to provide a temporary fill of the perforation 23. A yet further example of perforation may be a partial or blind perforation 25, wherein the perforation does not extend fully through the element 22*b*.

Figure 4:
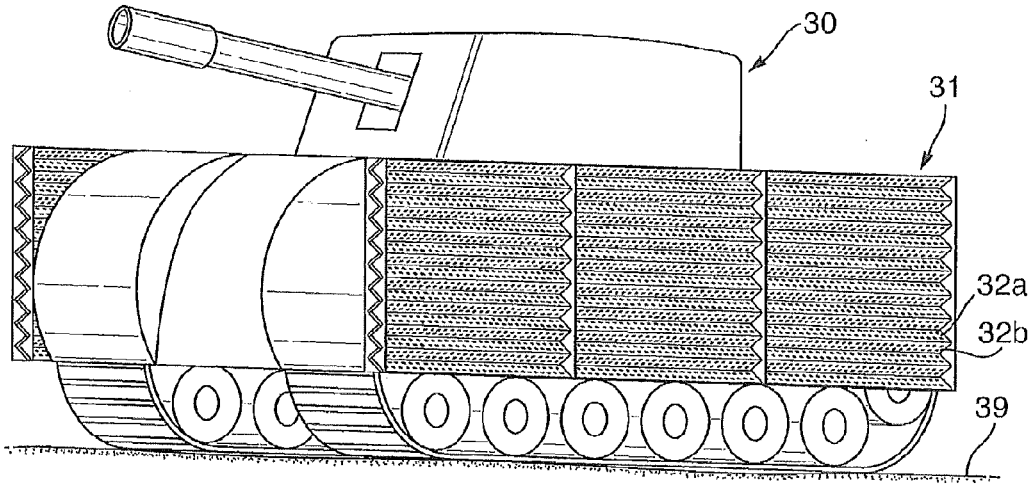
FIG. 4 shows a vehicle comprising an armor system as shown in FIG. 1.

FIG. 4 shows an armored vehicle 30, comprising an armor system 31, in the form of an applique system 31. The applique system, may be any dimension, such that there may be a plurality of applique systems mounted on the side of the vehicle. The vehicle has a ground plane 39 that the wheel base is located upon. The elements 32*a*, 32*b*, are arranged such that the axis of their longest dimension is substantially parallel to the ground plane 39 of the vehicle 30, during operation on substantially flat terrain. It may be desirable for an IR reflective coating to be applied to elements 32*a*, which nominally face skywards, such as to provide a thermal cold patch for identification purposes.

Figure 5:
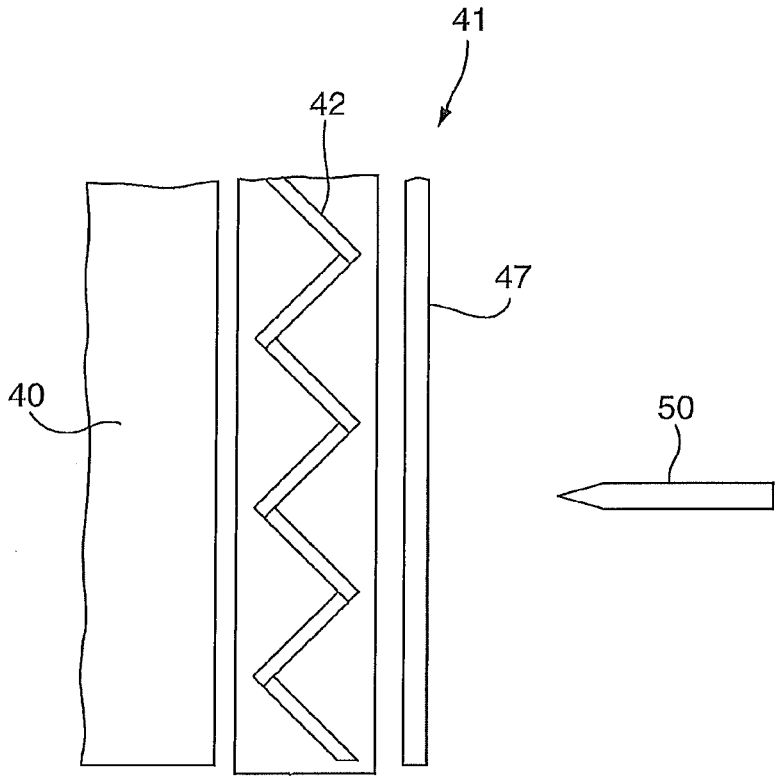
FIG. 5 shows a cross section of vehicle's armor in conjunction with the applique armor system and additional cover plate.

FIG. 5 shows a cross section of the armor applique arrangement 41 located upon the existing armor 40 on a vehicle (not shown). The armor 41, contains elements 42, with perforations (not shown), to defeat an incoming munition 50. Perforations of 8 mm are typically used on perforated armor plates which are substantially flat (and are mounted such that they are presented at the normal to the incoming round). In the present invention a 10 mm hole may be used as the perforation diameter when presented on a chevron with a 90° angle of separation between the elements 42, and provide the same effect. Clearly the use of a 10 mm diameter hole provides less machining costs, and a reduced mass system, whilst providing the same level of protection as afforded by a conventional flat armor plate with 8 mm perforations. Alternatively an 8 mm hole may be used, such that the perforation is capable of disrupting smaller diameter rounds. In the preferable embodiment shown in FIG. 5, the armor 41 further comprises an additional sheet of substantially flat armor material 47 located on the outer facing surface. In some preferable embodiments, the additional sheet of armor 47 also contains perforations.

Figure 6:
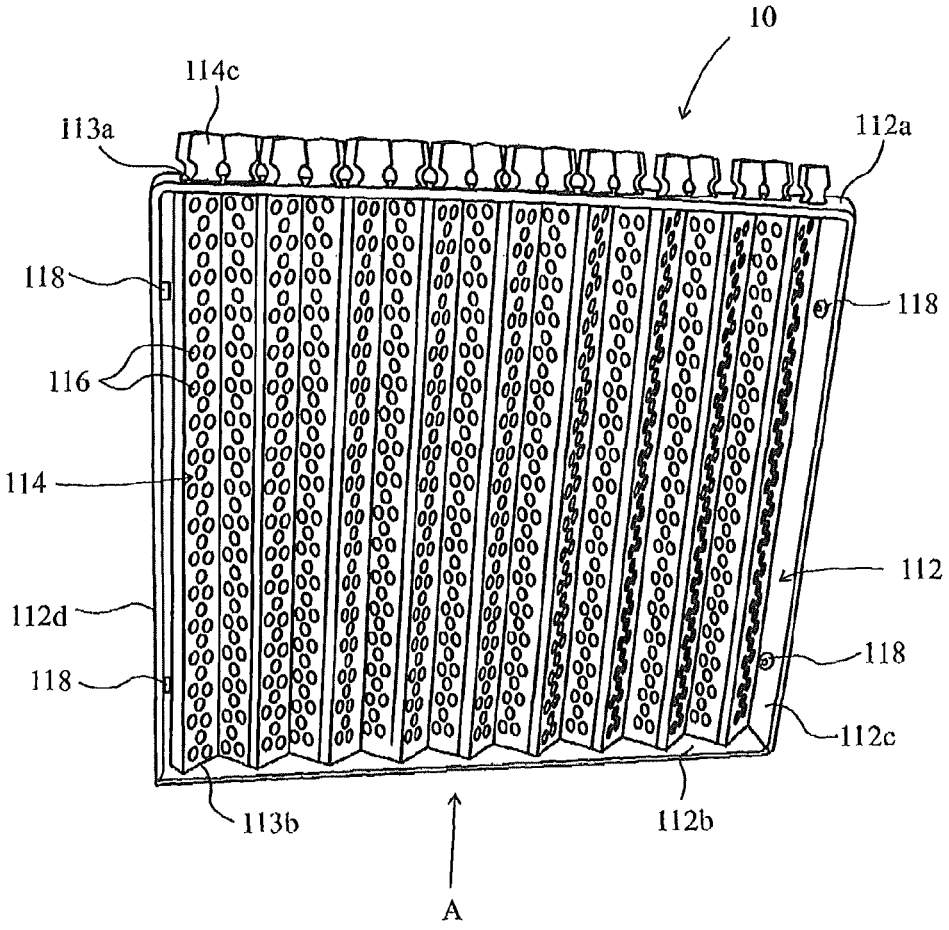
FIG. 6 is a perspective view of an armor assembly according to an embodiment of the present invention.

An armor assembly 110 according to an embodiment of the present invention is shown in FIG. 6. The armor assembly 110 comprises a frame 112 that is rectangular in shape and is formed from a top wall 112*a*, a bottom wall 112*b* parallel to the top wall 112*a* and spaced therefrom, and two side walls 112*c,d* connecting the top and bottom walls 112*a,b*, where the side walls 112*c,d* are orientated perpendicularly relative to the top and bottom walls 112*a,b*. The frame is rigid and is made from steel or a similarly rigid material.

The frame 112 has a plurality of armor plates 114 mounted thereto, where the armor plates 114 are perforated armor plates, each comprising a plurality of apertures 116 therethrough. The apertures 116 increase the number of edges present on the armor plates 114 and therefore increase the armor plates' 114 ability to prevent ballistic projectiles, such as bullets, from penetrating through the armor plates 114. One reason for this improved impenetrability is a consequence of the increased statistical likelihood that a ballistic projectile will at least partially contact one of the edges in the armor plates 114. When an impacting ballistic projectile strikes an edge, it experiences an increased pressure when compared to the pressure it would experience when striking a flat surface of the same material. This increased pressure increases the likelihood that the ballistic projectile disintegrates on impact or is deflected, thereby reducing its energy, therefore reducing the depth of penetration through the armor plate 114.

The frame 112 comprises fastening elements 118 that are used to attach the frame 112 (and therefore the entire armor assembly 110) to a vehicle so that the vehicle benefits from the protection provided by the armor assembly 110. In alternative embodiments, fastening means other than fastening elements 118 are used to attach the an armor assembly 110 to a vehicle. A vehicle may have several armor assemblies 110 attached to it to provide protection where desired. The armor assemblies 110 attached to the vehicle may be different sizes and shapes to one another to suit the shape of the vehicle.

Figure 7:
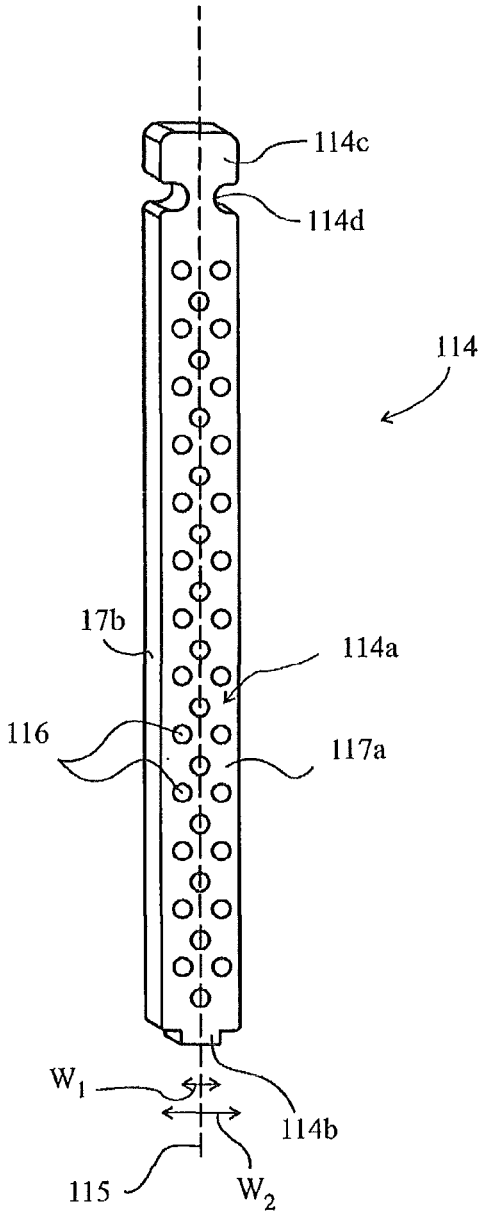
FIG. 7 is a detailed perspective view of an embodiment of an amour plate for use with the armor assembly of FIG. 6.
Figure 8:
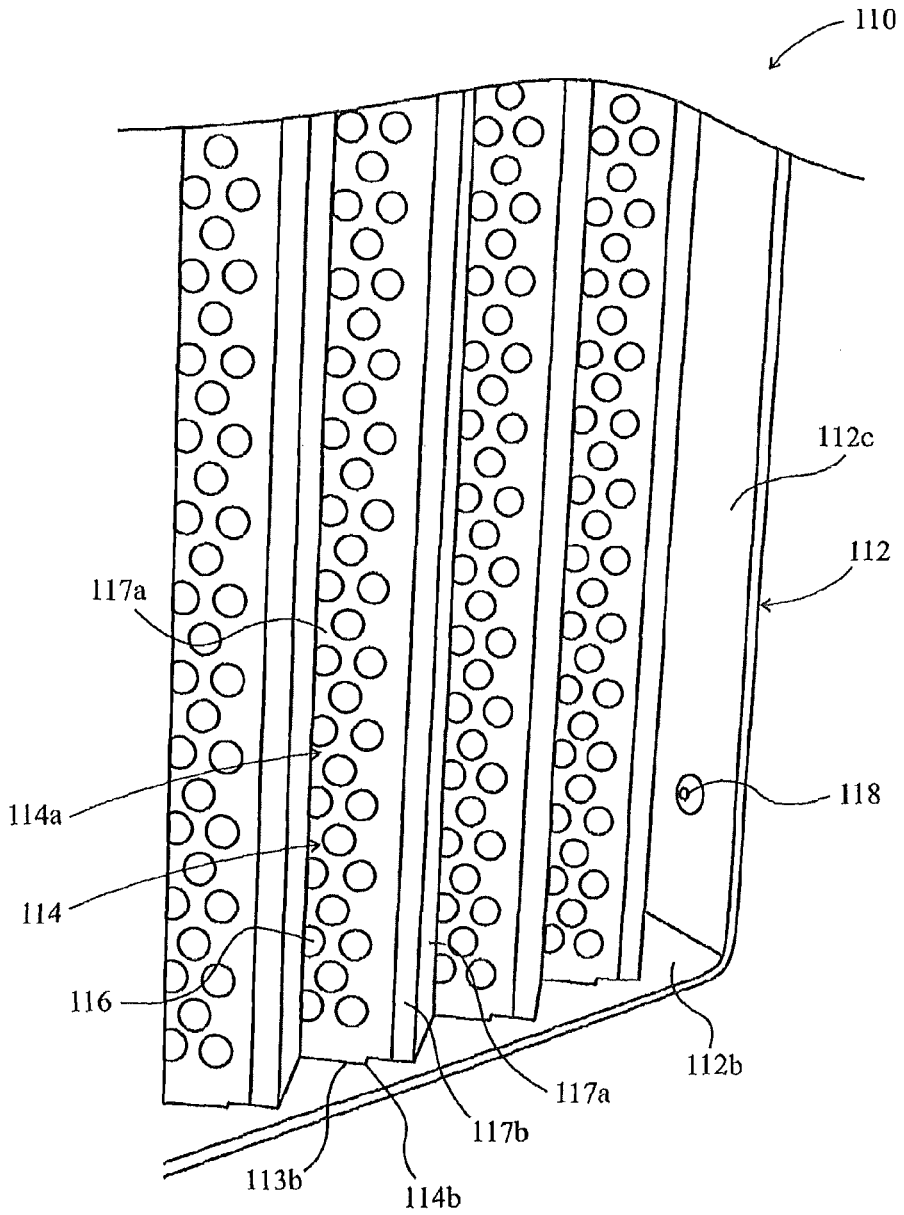
FIG. 8 is a detailed perspective view of a part of the armor assembly of FIG. 6.

FIG. 7 shows a detailed view of a single armor plate 114. The armor plate 114 is elongated along a longitudinal axis 115 of the armor plate 114, and comprises a body portion 114*a*, a bottom tab 114*b* extending from a bottom end of the body portion 114*a* in a direction parallel to the longitudinal axis 115, and a removal tab 114*c* extending from a top end (opposite the bottom end) of the body portion 114*a* in a direction parallel to the longitudinal axis 115. The bottom tab 114*b* has a width W.sub.1 that is less than a width W.sub.2 of the body portion 114*a*. The widths W.sub.1 and W.sub.2 are defined as being perpendicular to the longitudinal axis 115 of the armor plate 114 and in alternative embodiments, the bottom tab 114*b* may be smaller than the body portion 114*a* in any direction that is perpendicular to the longitudinal axis 115 and still perform its function, which will be described further below.

In the embodiment shown in FIGS. 6 to 9, the armor plate 114 comprises a narrow neck portion 114*d* between the removal tab 114*c* and the body portion 114*a*, however, in alternative embodiments, the removal tab 114*c* may simply be an extension of the body portion 114*a* having the same width as the body portion 114*a* with no neck portion 114*d* present. In other alternative embodiments, the removal tab 114*c* may have a width greater than that (W.sub.2) of the body portion 114*a*.

The body portion 114*a* has a face 117*a* and a side 117*b* that is perpendicular to the face 117*a*. The apertures 116 in the armor plate 114 are in the face 117*a* of the body portion 114*a* and extend through the body portion 114*a* in a direction perpendicular to the face 117*a*.

Returning to the embodiment shown in FIG. 6, the frame 112 defines a frame plane between the walls 112*a-d*, and the armor plates 114 are arranged in the frame so that their longitudinal axes 115 are all aligned (i.e. are parallel) with one another and parallel to the frame plane. The top wall 112*a* has a plurality of top slots 113*a* that are sized so the body portion 114*a* of the armor plates 114 can pass therethrough. The bottom wall 112*b* has a plurality of bottom slots 113*b* that are sized to receive the bottom tabs 114*b* of armor plates 114, but not allow the body portion 114*a* to pass therethrough.

The armor plates 114 are releasably mountable to the frame 112 where each armor plate 114 may be slotted through one of the top slots 113*a* until the bottom tab 114*b* passes through one of the bottom slots 113*b*. Once the bottom tab 114*b* passes through the bottom slot 113*b*, continued movement of the armor plate 114 relative to the bottom wall 112*b* is prevented by abutment between the body portion 114*a* and the bottom wall 112*b*, since each bottom slot 113*b* is sized to prevent the body portion 114*a* from passing therethrough. Therefore, once the armor plate 114 has been slotted through the top and bottom slots 113*a,b* until no further movement is permitted due to abutment between the body portion 114*a* and the bottom wall 112*b*, the armor plate 114 is in position for providing protection (i.e. a "protecting position").

Figure 9:
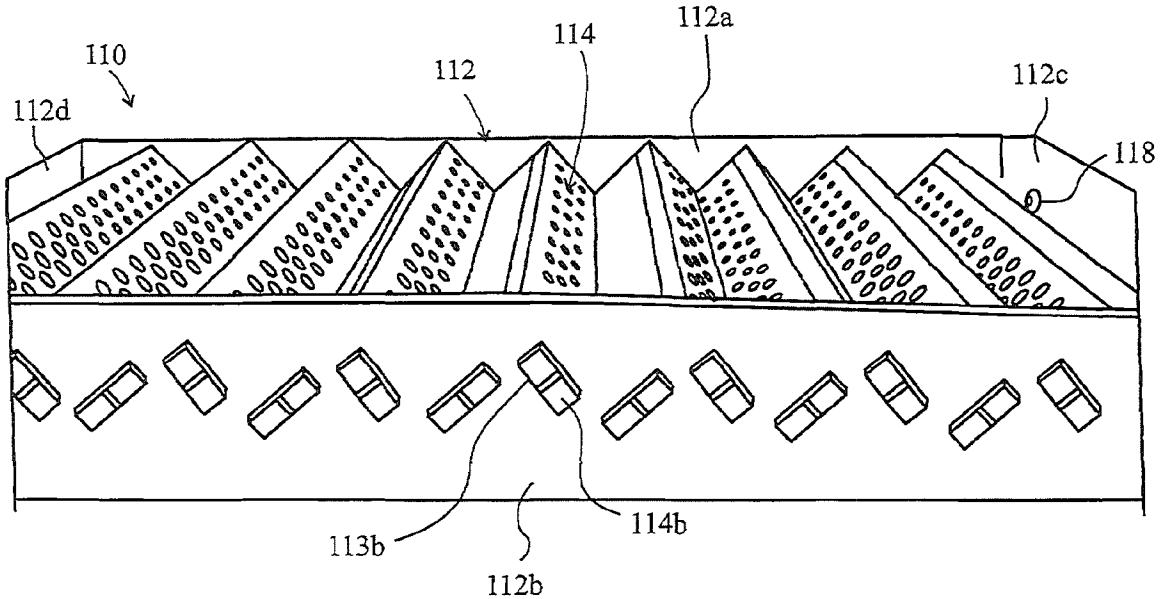
FIG. 9 shows a partial view of the armor assembly of FIG. 6 as viewed along direction A.

FIG. 9 shows a view of the armor assembly 110 along direction A shown in FIG. 6. In FIG. 9, the bottom tabs 114*b* of the armor plates 114 can be seen protruding through the bottom slots 113*b* of the bottom wall 112*b*. In alternative embodiments, the bottom slots may not pass all of the way through the bottom wall so that they are more recess-like but are still capable or receiving the bottom tabs 114*b* of the armor plates 114. In alternative embodiments, the top and bottom walls 112*a,b* may comprise formations other than slots which may serve as guides to allow the armor plates 114 to be releasably mountable to the frame.

In the protecting position, the removal tabs 114*c* of the armor plates 114 protrude from the top slots 113*a* outside of the frame plane and provide a means for gripping the armor plates 114 and removing them from the frame 112 by withdrawal through the top and bottom slots 113*a,b*. The removal tabs 114*c* may be configured to be gripped by hand so that a person can remove each armor plate 114 by hand. Alternatively, the removal tabs 114*c* may be configured to be engaged by a tool that may assist or automatically remove the armor plates 114 from the frame 112.

In an alternative embodiment, the top wall 112*a* may comprise two parts that are bolted or otherwise releasably attached together around the armor plates 114 in their protecting position. Thus, the two components of the top wall 112*a* may be opened to remove one or more armor plates 114 that may have become damaged and misshapen making removal through the slots 113*a* (or other formations) difficult or impossible. In this embodiment, the slots or other formations may still be present to allow mounting and unmounting of the armor plates 114 by methods that do not require opening the two part top wall 112*a* (provided that the armor plates 114 are not misshapen so as to prevent such mounting and unmounting).

In the embodiment shown in the Figures (see FIG. 8, in particular), the armor plates are orientated in the frame 112 so that the face 117*a* of each armor plate 114 is perpendicular to the face 117*a* of the adjacent armor plate(s) 114 forming a corrugated arrangement of armor plates 114. In this corrugated arrangement, the side 117*b* of each armor plate 114 (except an end armor plate 114) is parallel and flush with the face 117*a* of an adjacent armor plate 114. This arrangement therefore eliminates any significant gaps between adjacent armor plates 114 that may compromise the armor assembly's 110 ability to resist ballistic projectiles. Also, in the corrugated arrangement the edges of the apertures 116 of adjacent plates are orientated at different angles to one another which also improves the armor assembly's 110 ability to resist ballistic projectiles. In alternative embodiments, the armor plates 114 may be arranged in the frame 112 in a different arrangement (e.g. at different relative angles) to the one shown in the Figures. The chosen arrangement may depend on the anticipated threat (i.e. expected type of incoming ballistic projectile) or weight and shape considerations in relation to the vehicle the assembly 110 is to be fitted to.

In an alternative embodiment not shown in the Figures, the armor assembly 110 further comprises a locking mechanism that locks the armor plates 114 in their protecting positions within the frame. The locking mechanism may ensure that the armor plates 114 are not released nor move from their protecting positions inadvertently due to the motion of the vehicle or impact of ballistic projectiles.

In a preferable use of the armor assembly 110, the frame 112 is mounted to a vehicle such as an armored personnel carrier (APC). The armor plates 114 arranged in their protecting positions in the frame 112 provide protection to the vehicle and its occupants. When the vehicle is travelling in known safe areas, the armor plates 114 may be removed from the frame 114 by gripping the removal tabs 114*c* of the armor plates 114 and withdrawing them from the bottom slots 113*b* and through the top slots 113*a* out of the frame 112. In the above-described embodiment where the top wall 112*a* comprises two parts releasably attached to one another, the armor plates 114 may also be unmounted from the frame 112 by opening the two-part top wall 112*a* and removing the armor plates 114. With the armor plates 114 removed, the overall weight of the vehicle will be reduced and the speed, acceleration and maneuverability will not be hindered. In preferable embodiments the frame 112 remains attached to the vehicle once the armor plates 114 have been removed so that they may be easily and quickly mounted back on the frame 112 should protection be required again. The vehicle is therefore provided with means (i.e. the frame 112) to receive armor plates 114 whenever needed. An additional advantage of the present invention is that different types of perforated armor plates (e.g. thinner or thicker) may be easily fitted to the vehicle, provided that they fit with the frame 112 attached to the vehicle 112. Another advantage of the present invention is that individual armor plates 112 may be removed and replaced if damaged. Thus, the present invention is cost effective and requires less labour when compared to prior art arrangements where a whole armor plate (which is traditionally very large) requires unmounting from the vehicle and replacing in its entirety. The requirement of a large armor plate is negated in the present invention by the provision of the armor assembly 110 which comprises multiple smaller armor plates 114 thereby affording ease of use, cost effectiveness and improved operating of the vehicle, whilst providing a desired level of protection.

The skilled reader will appreciate that any non-mutually exclusive features described above in relation to FIGS. 1 to 5 may be combined with or interchanged with the features described above in relation to FIGS. 6 to 9.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described In conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. An armor system, comprising:

a rigid frame formed from a top wall, a bottom wall, and two side walls; and at least two elongate armor plates that each have an elongate axis, wherein said elongate armor plates are arranged inside said rigid frame and in a chevron pattern at a non-zero angle (α)° with respect to one another and with said elongate axes of said elongate armor plates arranged substantially parallel with respect to one another, wherein said at least two elongate armor plates comprise a plurality of perforations and further wherein each of said elongate armor plates provides an outermost surface of the armor system;

wherein the armor system is a removable appliqué system, wherein the at least two elongate armor plates are fixed with respect to each other, and wherein the armor system comprises a plurality of sets of said at least two elongate armor plates constructed and arranged in a repeating arrangement.

2. An armor system according to claim 1, wherein perforations of said elongate armor plates have a shortest dimension which is less than a diameter of a primary threat projectile.

3. An armor system according to claim 1, wherein perforations of said elongate armor plates have a cross sectioned shape selected from circular, square, elliptical, and a slot.

4. An armor system according to claim 1, wherein perforations of said elongate armor plates have a beveled edge, so as to provide different cross section size on a front face and rear face of said at least two elongate armor elements.

5. An armor system according to claim 1, wherein each perforation has a longest dimension, and the distance between each perforation is at least one half of the length of said longest dimension.

6. An armor system according to claim 1, wherein the perforations are filled with a potting compound.

7. An armor system according to claim 1, wherein there is provided an IR reflective coating on at least one of the at least two elongate armor plates.

8. An armor system according to claim 1, wherein one or more elongate armor plates are independently removable.

9. An armor system according to claim 1, wherein the at least two elongate armor plates are arranged, such that the elongate axis is substantially parallel with respect to a ground plane, upon which a vehicle wheel base is located thereon.

10. An armor system according to claim 1, wherein the elongate armor plates are assembled in said frame at a non-zero V-shaped angle between 40 degrees and 130 degrees with respect to one another.

11. An armor system according to claim 1, wherein the at least two elongate armor plates abut each other along a longest dimension of each elongate armor plate, so as to form a repeating arrangement of the at least two elongate armor plates.

12. An armor assembly comprising:

a rigid frame formed from a top wall, a bottom wall, and two side walls, the rigid frame arranged to be attached to a vehicle; and at least two elongate armor plates that each have an elongate axis, wherein said elongate armor plates are arranged inside said rigid frame and in a chevron pattern at a non-zero angle (α)° with respect to one another and with said elongate axes of said elongate armor plates arranged substantially parallel with respect to one another, wherein each of said elongate armor plates provides an outermost surface of the armor system;

wherein each of the plurality of armor plates comprises a plurality of apertures therethrough, wherein the armor assembly is a removable appliqué system, wherein the at least two elongate armor plates are fixed with respect to each other, and wherein the armor assembly comprises a plurality of sets of said at least two elongate armor plates constructed and arranged in a repeating arrangement.

13. An armor assembly according to claim 12, wherein the frame defines a frame plane, where each of the plurality of armor plates has a longitudinal axis and is releasably mountable to the frame so that each longitudinal axis may be orientated substantially parallel to the frame plane.

14. An armor assembly according to claim 13, wherein the frame has four walls including a top wall, a bottom wall and two side walls extending between the top and bottom walls; and wherein the top wall comprises top guides and the bottom wall comprises bottom guides, and the top and bottom guides are arranged so that each of the plurality of armor plates is releasably mountable in both a top guide and a bottom guide.

15. An armor assembly according to claim 13, wherein the plurality of armor plates may be orientated so that each armor plate is adjacent to at least one other armor plate.

16. An armor assembly according to claim 15, wherein the frame has four walls including a top wall, a bottom wall and two side walls extending between the top and bottom walls; and wherein the top wall comprises top guides and the bottom wall comprises bottom guides, and the top and bottom guides are arranged so that each of the plurality of armor plates is releasably mountable in both a top guide and a bottom guide.

17. An armor assembly according to claim 15, wherein each of the plurality of armor plates has a face, and the plurality of armor plates may be orientated so that the face of each armor plate is perpendicular to the face of the at least one other armor plate.

18. An armor assembly according to claim 17, wherein the frame has four walls including a top wall, a bottom wall and two side walls extending between the top and bottom walls; and wherein the top wall comprises top guides and the bottom wall comprises bottom guides, and the top and bottom guides are arranged so that each of the plurality of armor plates is releasably mountable in both a top guide and a bottom guide.

19. An armor assembly according to claim 12, wherein the frame has four walls including a top wall, a bottom wall and two side walls extending between the top and bottom walls; and wherein the top wall comprises top guides and the bottom wall comprises bottom guides, and the top and bottom guides are arranged so that each of the plurality of armor plates is releasably mountable in both a top guide and a bottom guide.

20. An armor assembly according to claim 19, wherein the top guides are top slots in the top wall and the bottom guides are bottom slots in the bottom wall, wherein each of the slots is arranged to receive one of the plurality of armor plates.

* * * * *